United States Patent [19]

Crandall

[11] 4,007,865

[45] Feb. 15, 1977

[54] WEB GUIDING AND CENTERING APPARATUS

[75] Inventor: Nelson B. Crandall, Edenton, N.C.

[73] Assignee: Cape Colony Manufacturing, Inc., Edenton, N.C. ; a part interest

[22] Filed: Aug. 27, 1975

[21] Appl. No.: 608,205

Related U.S. Application Data

[63] Continuation-in-part of Ser. No. 512,302, Oct. 4, 1974, abandoned.

[52] U.S. Cl. ..... 226/17; 26/97; 226/180; 226/187

[51] Int. Cl.[2] ..... B65H 25/26

[58] Field of Search ..... 226/180, 17, 199, 187; 26/54, 63, 67, 77, 78, 97

[56] References Cited

UNITED STATES PATENTS

| | | | |
|---|---|---|---|
| 1,919,291 | 7/1933 | Coolidge | 226/17 X |
| 2,047,212 | 7/1936 | Lovell | 26/78 |
| 2,451,343 | 10/1948 | Kunzle | 226/17 X |

*Primary Examiner*—Richard A. Schacher

[57] ABSTRACT

A web guiding and centering apparatus for guiding and centering a moving web of substantially constant width relative to a fixed center line includes two guiding devices positioned equally distant from the selected center line, each guiding device comprising a pair of co-acting guide rolls inclined in the direction of travel of the moving web for engaging an edge portion of the web on opposite faces thereof. One guide roll of each pair is pivotally and resiliently biased toward the other roll of the same pair about a pivot which is outboard of the web. At least one roll of each pair has a composite surface which includes an outboard surface portion of relatively hard, low coefficient of friction material and an inboard surface portion of a relatively soft, high coefficient of friction material. The inclined relationship of the co-acting rolls of each pair relative to the direction of travel of the web, the biased, pivotal relationship of the co-acting rolls relative to each other, and the difference in relative hardness and coefficient of friction of the inboard and outboard surface portions of at least one roll of each pair of rolls result in cyclical action between the rolls and web which causes the opposite edges of the web to be guided substantially uniformly with respect to a selected fixed center line. A modification of each guiding device includes a recessed area, or alternatively a bump on one roll face for augmenting the response of the guide rolls.

25 Claims, 11 Drawing Figures

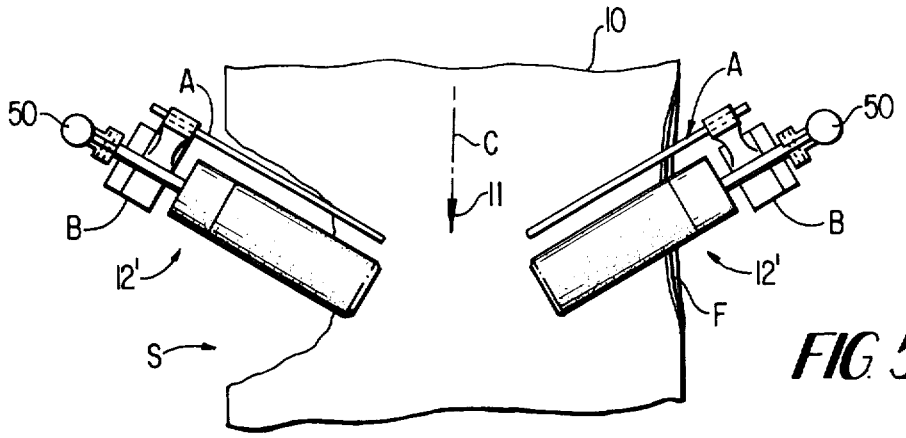
FIG. 5
FIG. 6
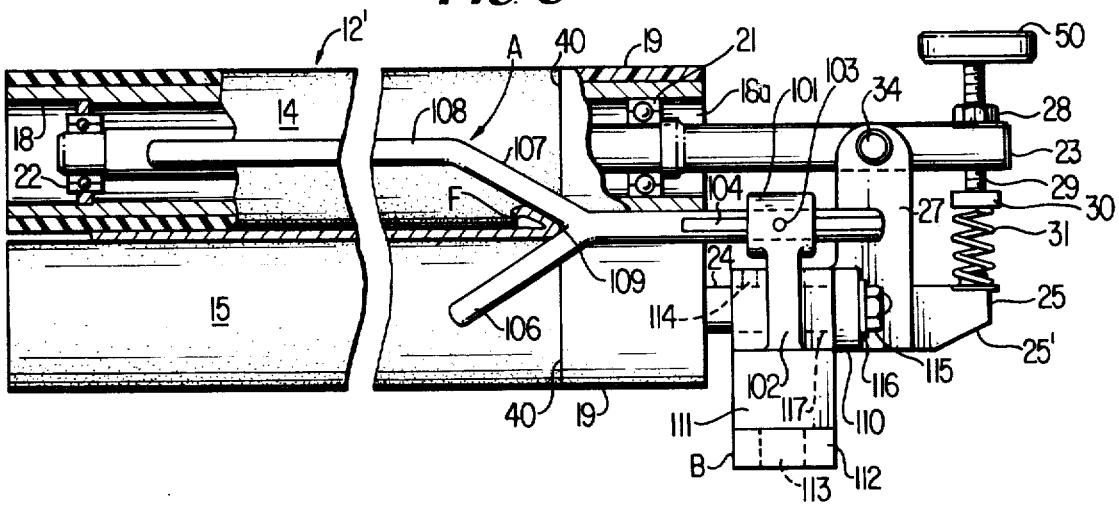
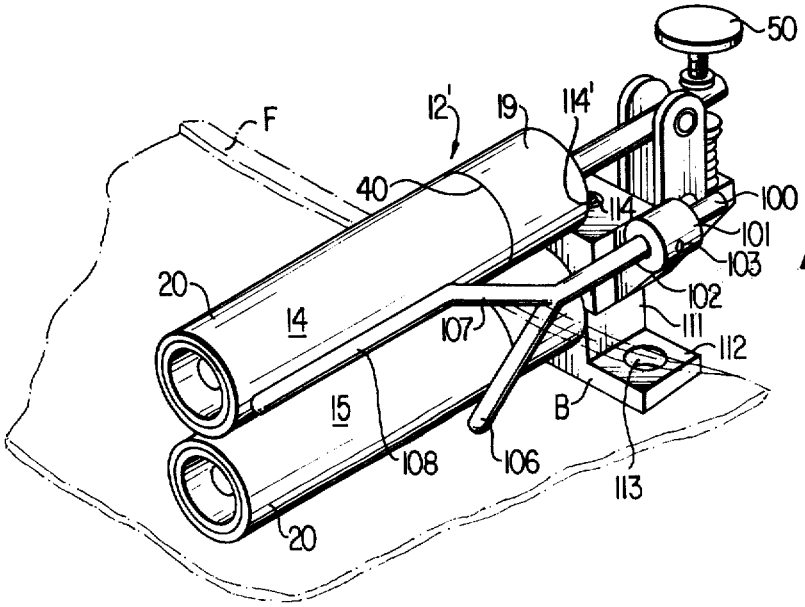
FIG. 7

WEB GUIDING AND CENTERING APPARATUS

RELATED APPLICATION

This application is continuation-in-part of my patent application Ser. No. 512,302, filed Oct. 4, 1974 entitled Web Guiding and Centering Apparatus and now abandoned.

BACKGROUND OF THE INVENTION

1. Field of the Invention

This invention relates to apparatus for guiding a moving web uniformly with respect to a fixed center line.

2. Description of the Prior Art

Many devices have been devised for edge guiding and centering a moving web with respect to a fixed center line. Some of the prior art devices, like the present invention, include co-acting rolls which are angularly inclined in the direction of travel of the web for engaging opposite faces of a marginal region of the web and in various ways exert lateral forces on the web tending to position the web relative to a fixed center line. However, many of the prior art devices which included co-acting rolls depend upon a mechanical finger, air jet, photo cell, or other sensor to detect the presence, or absence of the edge of the web and to signal an air cylinder, electric solenoid, or the like to vary the pressure at the nip of the rolls and thus to effect the guiding action of angularly disposal rolls. Such devices because they require a sensor and associated mechanism to vary the roll pressure are of varying degrees of complexity.

SUMMARY OF THE INVENTION

It is an object of this invention to provide apparatus for automatically centering a moving web relative to a predetermined center line by means of co-acting guide rolls alone without the use of edge sensing fingers, air jets, photocells, or the like which apply signals to responsive mechanisms for controlling the rolls.

It is an important object of this invention to provide two pair of co-acting guide rolls which are adjusted to be equidistant from a selected center line of the moving web to guide and automatically center the moving web. The guide rolls of each pair engage opposite faces of a moving web along an edge region of the web. The rolls of each pair are inclined in the direction of travel of the web. One roll is mounted to rotate about a fixed axis while the other roll is mounted to rotate about an axis which is pivoted outboard of the edge of the web to swing in a single common plane normal to the web and containing the fixed axis of the one roll. An adjustable resilient biasing means is provided which biases the roll having the pivoted axis toward the roll with the fixed axis. Each roll has a composite cover which includes an outboard cover portion of a relatively hard, low coefficient of friction material, and an inboard cover portion of a relatively soft, high coefficient of friction material. The two cover portions of each roll abut each other along a circular line of junction which is intermediate the ends of the rolls. The inboard cover portions of the rolls of one pair when engaged with one edge portion of a moving web exert a force acting in a laterally outward direction on the web which tends to move the one edge outwardly from the predetermined center line. However, when the edge of the web is moved under the hard, low coefficient of friction outboard cover portions, the rolls tend to spread apart so that the one edge portion of the web is no longer engaged by the inboard cover portions. The low coefficient of friction of the outboard cover portions of the rolls permits slippage of the one edge portion of the web from between the outboard cover portions by a laterally inwardly directional force resulting from the opposite pair of guide rolls. The guide rolls acting on the one edge will then be forced together by the resilient biasing means until the inner cover portions again exert a force component in the laterally outward direction. The cyclical action of the two pairs of coacting rolls on opposite edge portions of the moving web resulting from the inclined relationship of the rolls relative to the direction of travel of the web, the pivotal relationship of the rolls in each pair relative to each other, and the difference in relative hardness and coefficient of friction of the inboard and outboard cover portions of the rolls cause the edges of the web to be guided substantially uniformly with respect to a selected fixed center line.

One of the rolls of each roll pair need not have a composite surface, but could have a single metal, fiber, plastic, or plastic coated metal surface, so long as the mating roll is of the composite surface type. It is, however, within the scope of this invention that each roll of each pair be a composite roll of the type previously described, and alternatively that only one roll of each pair be a composite roll. The preferred materials for the inboard and outboard surface portions of the composite roll are rubber and "Teflon" respectively. Other materials may be used as will be subsequently described.

It is another object of this invention to provide means for preventing a web from being continuously pulled to one side by the action of one of a pair of guiding devices in the event that the web is, for some reason, disengaged from the opposite guiding device. Occasionally, in handling a web such as a woven or knit fabric a sample piece is cut from one selvedge of the otherwise continuous strip leaving a cut or scallop that would cause that edge to run out of its guiding device. The opposite guiding device, still in engagement would tend to pull the web in its favored direction unopposed by its counterpart. The means provided includes a Y-shaped yoke which is mounted so that the fork of the Y engages an edge of the web to permit the web material to gather and fold so that there is a multiple thickness of material running through the outboard Teflon covered section of the guiding device tending to open the nip of the guide rolls even further than a single thickness of fabric would and thereby further reducing the effectiveness of the inboard rubber covered section of the rolls in pulling the web to its side. The web would then tend to run somewhat off center (until the equipment operator re-engaged the opposite guider) but not so severly as to cause an equipment malfunction or problem.

With the foregoing objects and features in view and such other objects and features which may become apparent as this specification proceeds, the invention will be understood from the following description taken in conjunction with the accompanying drawing, in which like characters of reference are used to designate like parts, and in which:

FIG. 5 is a view similar to FIG. 1 showing two pairs of modified guiding devices acting on opposite edges of a moving web;

FIG. 6 is an elevational view with portions broken away of one of the modified guiding devices shown in FIG. 5 with portions of the upper roll shown in section;

FIG. 7 is a perspective view of one the modified guiding devices shown in FIG. 5;

BRIEF DESCRIPTION OF THE PREFERRED EMBODIMENT

Figure 1:
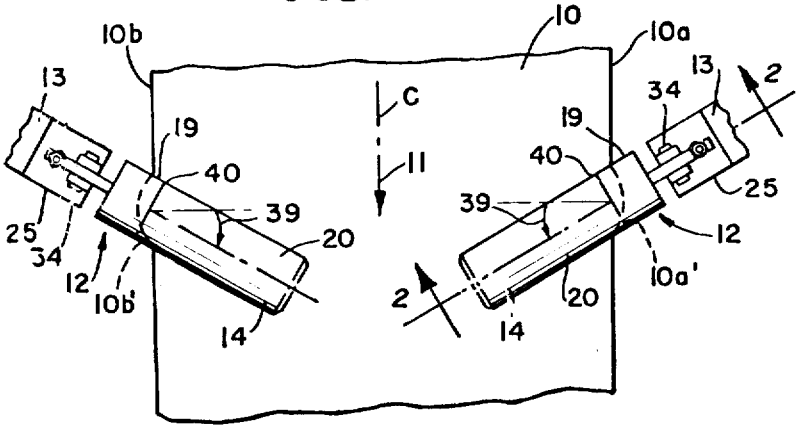
FIG. 1 is a top plan diagramatic view of the invention showing two pairs of cooperating guide rolls of the invention acting on opposite edges of a web.
Figure 3:
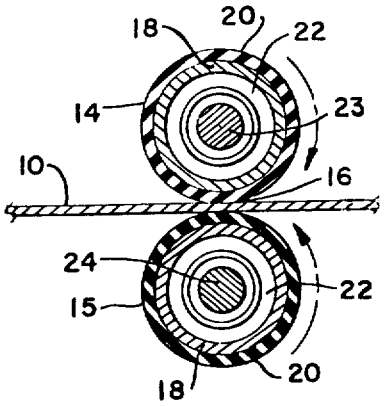
FIG. 3 is a vertical, transverse cross-sectional view taken along line 3—3 of FIG. 2.

Referring now to the drawing and particularly to FIG. 1 a web 10 moving in the direction of the arrow 11 is shown being guided along a selected center line C by two guiding devices 12 which are positioned on suitable supports 13 for lateral adjustment relative to the center line in order to accommodate webs of different widths. The supports 13, which are shown as an angle arm having a horizontal portion 13*a* and a vertical portion 13*b*, are preferably carried by a movable stand (not shown) or other means permitting lateral adjustment of the support arms 13 relative to a desired center line.

Figure 2:
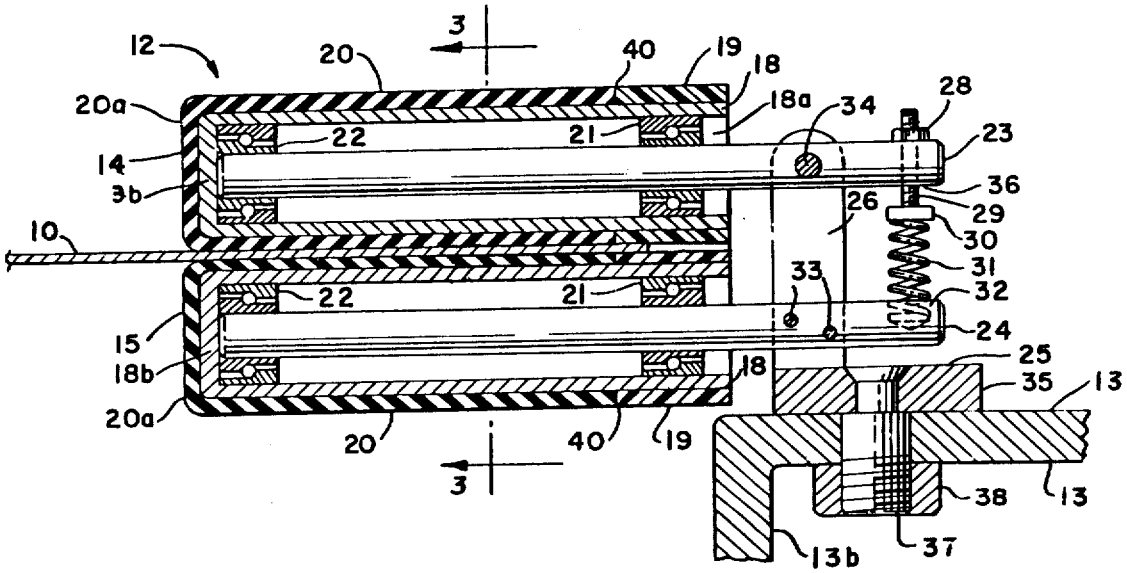
FIG. 2 is a vertical sectional view taken along line 2—2 of FIG. 1.
Figure 4:
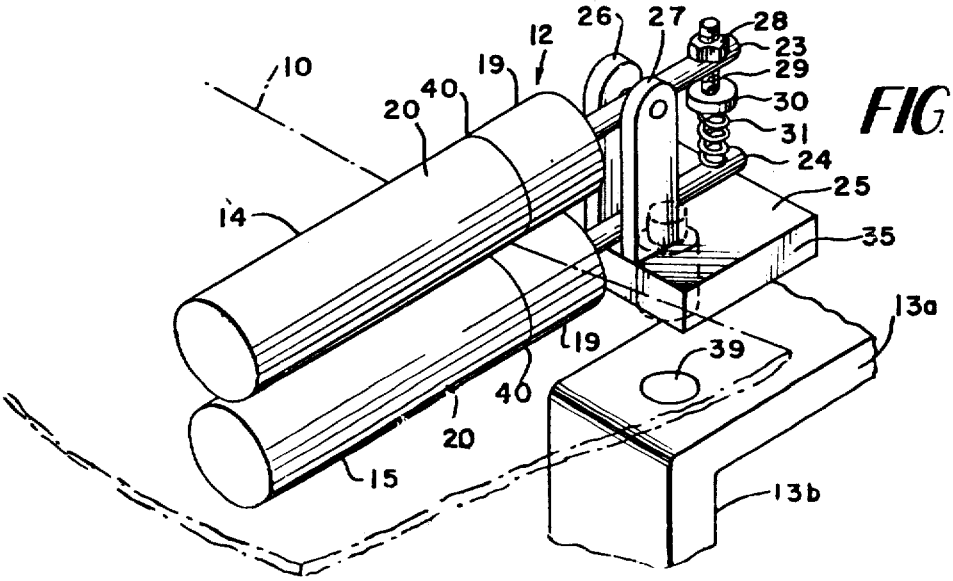
FIG. 4 is a perspective view of one pair of cooperating guide rolls of the invention.

Each guiding device 12, as shown in FIG. 2, comprises a pair of co-acting cylindrical rolls 14 and 15 which engage one of the longitudinal edge portions of the web 10 on its opposite faces in the nip 16 between the rolls. The rolls 14 and 15 are of like construction comprising a hollow inner cylinder 18 having a composite outer cover which includes an outboard cover portion 19 of a relatively hard, low coefficient of friction material, preferably one of the fluorocarbon resins such as "Teflon", and an inboard cover portion 2*a* of a relatively soft, high coefficient of friction material, such as an elastomeric rubber, either natural or synthetic. The outboard and inboard cover portions 19 and 20 are cylindrical and their adjacent ends meet along a circular line of junction 40. The cover portions 19 and 20 are retained on the cylinder 18 preferably by tight frictional contact therewith, adhesives, or other suitable means. The inboard end of each inboard cover portion 20 is closed by an integral end wall 20*a* which presents a smooth surface to the web 10, thus avoiding damaging effects upon the web which might be caused by rough edges. The outboard ends 18*a* of the cylinder 18 are open while the inboard ends are preferably closed by an integral end wall 18*b*. A pair of antifriction bearings 21 and 22 are positioned within each of the hollow cylinders 18 adjacent their open and closed ends 18*a* and 18*b* respectively for rotatably mounting the rolls 14 and 15 on axles 23 and 24 respectively inserted through the open ends 18*a* of the cylinders 18. The axle 24 is fixedly supported near its outboard end between the spaced upstanding arms 26 and 27 of a support bracket 25 by a pair of fasteners 33. The axle 23 is pivoted near its outboard end between the arms 26 and 27 above the axle 24 by a pivot pin 34 which passes transversely through the arms 26 and 27 and through the longitudinal axis of the axle 23. A compression spring 31 having one end seated in a bore 32 on the top side of the axle 24 has its other end seated against the enlarged head 30 of a bias adjustment screw 29. The screw 29 passes through a vertical bore 36 at the outboard end of the pivoted axle 23, and is threaded into a nut 28 affixed to the top side of the axle 23. By adjusting the screw 29 in or out relative to the axle 23, the spring bias exerted on the axle 23 may be decreased or increased respectively. The bracket 25 has a horizontal base 35 from which a threaded stud 37 depends. The stud 37 passes downwardly through the vertical bore 39 in the support 13 so that the bracket 25 may be tightened on the support 13 by tightening the nut 38. The bracket 25 may be turned when the nut 38 is loose to adjust the angle 39 which the axis of the rolls 14 and 15 makes with respect to a line perpendicular to the selected center line C for the moving web 10. The two guiding devices 12 on the opposite sides of the web 10 are set at the same angle 39 relative to the selected center line so that each device will exert substantially equal but opposite force components on the web 10 when the web is running straight.

OPERATION OF THE PREFERRED EMBODIMENT

First assume that the web 10 is running straight with the center of the web moving along the desired center line C, and the side edges 10*a* and 10*b* of the web moving in a linear direction to enter the nip 16 between the co-acting roll pairs of opposite guiding devices 12, 12 approximately at the point of intersection of a center line along the nip 16 and the circular line of junction 40 between the inboard and outboard cover portions 19 and 20. Under the above said assumed conditions the opposite edge portions of the web 10 will be engaged between the inboard cover portions 20 of the co-acting rolls 14 and 15 of each guiding device 12 and only slightly, if at all, between the outboard cover portions 19. The compression spring 31 biases the roll 14 toward the roll 15 so that considerable pressure is applied to hold the rolls together. The co-acting rolls 14 and 15 will exert on the edge portions of the web a force having a substantial lateral component which tends to pull the web in the roll nip laterally outwardly as long as the edge is inboard of the "Teflon" outboard cover portion of the rolls. If the web 10 is a textile fabric, or other material having a lateral stretch capability, the web tends to widen somewhat at the nip of the rolls as indicated at 10*a*' and 10*b*' in FIG. 1 but the elasticity of the material will tend to bring it back to its relaxed width (subject to the narrowing effect of tension in the direction of travel of the web 10 and not a function of the guiding devices 12). As long as no external forces (other than the forces exerted by the guiding devices 12) are present which tend to pull the web off center the web 10 will remain substantially centered because the guiding devices 12 on opposite sides of the web produce lateral force components in opposite directions which are substantially balanced.

In practical applications lateral forces will be present which tend to move the web off center, and if the web is being wound on a roll, the edges of the web will be wound unevenly on the roll in the absence of effective centering devices as afforded by the present invention.

When a lateral external force is present to pull the web to one side, for example, to the right as viewed in FIG. 1, the right hand edge 10*a* of the web will move between the Teflon outboard cover portions 19 of the rolls 14 and 15 and the rolls will tend to separate slightly from a normally parallel position to a slightly divergent position because of the thickness of the web and relative hardness of the outboard cover portions 19 which will not permit the outboard cover portions to be deflected radially inwardly as is the case with the softer inboard cover portions 20. With the rolls 14 and 15 thus spread slightly apart, the inboard cover portions 20 will cease to be effective in exerting a lateral force component on the web which then tends to slip on the low coefficient of friction surfaces of the outboard cover portions 19 as a result of the lateral force exerted to the left by the left hand guiding device 12 which still effectively retains the left hand edge of the web between its inboard cover portions 20. As the web slips back so that the edge 10*a* is inboard of the outboard cover portions 19, the compression spring 31 again closes the rolls 14 and 15 so that the soft, high coefficient of friction inboard cover portions 20 are again effectively engaged with opposite faces of the right hand edge portion of the web 10. The alternate action of the inboard and outboard cover portions 19 and 20 as the rolls 14 and 15 alternately close and spread apart with lateral movement of the right hand edge portion of the web, will cyclically repeat as long as there is present a lateral force tending to move the web off center to the right. If the external lateral force shifts to the left hand direction, the left hand guiding device 12 will respond cyclically in the same way as has been described above with respect to the right hand guiding device. As a result of the guiding action of the guiding devices 12, 12 on opposite edges of the web, the edges 10*a* and 10*b* tend to ride along uniform lines approximately through the juncture 40 of the inboard and outboard cover portions 19 and 20 at the nip 16. Thus guided along a uniform path, a web of substantially constant width may be wound in a clean edged roll, or two webs may be positioned together with opposite edges side by side for laminating to cite only two of various uses which the guiding apparatus of this invention has.

It is intended that the guiding devices 12 be used in pair-one left, and one right as shown in FIG. 1 and that they be mounted on an adjustable support, or an adjustable frame permitting webs of various widths to be handled by moving the guides 12, 12 closer together or further apart.

The desired closing force exerted by the compression spring 31 will be a function of the thickness and types of material to be handled, the size of the guide rolls 14 and 15 and the material that the rolls are made of.

While Teflon and rubber have been described as the preferred materials from which the outboard and inboard cover portions are made respectively, other materials may be satisfactory. The selection criteria is that the inboard cover portion 20 be softer (durometer) and have a higher coefficient of friction than the outboard cover portion 19. For example, a soft polyurethane elastomer may be used for the inboard cover portion and steel may be used for the outboard roll portion 20 when handing a thin hard web material such as paper.

The angle 39 at which the co-acting rolls 14 and 15 are set will be determined experimentally for an optimum setting. It will always be an acute angle greater than zero and less than ninety degrees.

While the rolls 14 and 15 have been described as metal cylinders covered with outboard and inboard cover portions, it is within the scope of this invention that the rolls comprise an inboard cylindrical roll portion of a soft, high coefficient of friction material and, an outboard cylindrical roll portion of hard, low coefficient of friction material joined to the inboard section along a circular line of junction 40 and omitting the inner cylinder 18. Bearings 21 and 22 would thus bear directly against the inner surfaces of the outboard roll portion and the inboard roll portion respectively to rotatably support the rolls on their axles.

In some cases it may be desirable to include an additional means A shown in FIGS. 5–7 for preventing the web 10 from being continuously pulled to one side by the action of one of two guiding devices 12′, 12′ in the event that the web is, for some reason, disengaged from the opposite guiding device. Occasionally, in handling a web 10 such as a woven or knit fabric, a sample piece is cut from one selvedge of the otherwise continuous strip leaving a cut or scallop that would cause that edge to run out of its guide 12′. The opposite guide 12′, still in engagement, would tend to pull the web in its favored direction unopposed by its counterpart. For this purpose a Y-shaped yoke or attachment A is provided for each pair of guide rolls to permit the web material to gather and fold so that there is a multiple thickness of material running through the Teflon covered section of the guide rolls tending to open the nip of the guide rolls even further than a single thickness of fabric would and thereby further reducing the effectiveness of the rubber covered section of the rolls in pulling the web to its side. The web would then tend to run somewhat of center until the equipment operator re-engages the opposite guide rolls but not so severly as to cause an equipment malfunction or problem.

Referring more specifically to FIGS. 5–7, a web 10 and web guiding devices 12′, 12′ are or may be substantially the same as those previously described in reference to FIGS. 1 to 4. As shown, the attachments A are removably supported ahead of the guide rolls 14 and 15 (with respect to the direction of travel of the web 10) upon mounting brackets B of the apparatus which carry the guide rolls and extend parallel to the guide rolls. In its preferred form, each attachment A comprises a Y-shaped yoke having a central leg, or a stem portion, 100 which extends through an opening in a cylindrical support member 101 carried by a bracket arm 102 and suitably retained in any adjusted position by means of a fastener 103, such as a set screw, which extends into a groove 104 extending along the stem 100. The stem 100 terminates in divergent branches 106 and 107, which extend lengthwise in a plane parallel to the plane of the adjacent rolls 14, 15. The branch 107 is provided with an extension 108 which terminates near the outer end of the upper roll 14. The yoke attachments A are mounted so that the apex 109 formed between the branches 106 and 107 is positioned laterally outward of the junction 40 between the outbound and inbound surface portions 19 and 20 of the rolls 14 and 15. When the web 10 is properly centered with respect to the center line C, its edges 10*a* and 10*b* would normally run freely between the branches 106 and 107 of opposite yoke attachments A without contact therewith. However, in the event that there is a cut or scallop in one edge of the web, as shown at S in FIG. 5, the left guiding device 12′ (as viewed in FIG. 5) disengages the web and the right guiding device 12′ tends to pull the web increasingly to the right. Excessive movement of the web to one side beyond the outer edges of the guide rolls might cause the edge of the web to tangle with the guide rolls and/or their supports and damage the web. The yoke attachment A prevents excessive lateral movement of the web 10 by engaging the edge of the web and folding the edge back upon the main portion of the web. The fold F thus formed as seen in FIGS. 5–7, provides a double thickness of the web between the guide rolls 14 and 15 on the side where the fold is made. The double web thickness between the rolls 14 and 15 causes the rolls to spread increasingly further apart as the fold F moves laterally outward until the fold F enters between the outer surface portions 19 of the rolls 14 and 15. Once the fold has entered between the outer surface portions of the rolls which are of low coefficient of friction, the rolls have spread apart sufficiently so that the high coefficient of friction inbound surface portions 20 no longer contact the web. The outer surface portions 19 because of their low coefficient of friction do apply sufficient lateral force on the web to cause further outward lateral movement, thus the web 10 tends to run somewhat off center, but not excessively so, until an operator reengages the opposite guiding device with the web.

It will be observed from viewing FIGS. 6 and 7 that the rolls 14 and 15 shown therein have been modified slightly from the rolls shown in FIGS. 1–4 by leaving their inner ends as well as their outer ends open. The axle 23 of the upper roll 14 is pivoted near its outboard end between the spaced upstanding arms 26 and 27 of a support bracket 25 by a pivot shaft 34. The bracket 25 has a right angle base projection 25' which supports the bottom end of compression spring 31. The upper end of the compression spring 31 is seated in a spring holder 30 which is attached to the bottom end of an adjusting screw 29. The adjusting screw 29 extends through a transverse bore (not shown) in the axle 23 and threadedly engages the adjustment nut 28 affixed to the axle 23. A hand wheel 50 on the upper end of the adjustment screw 29 faciliates manual turning of the screw 29 for adjusting the bias on the spring 31. The bracket 25 includes a pair of opposite ears 110 (only one shown) projecting laterally at right angles near the base of the upstanding arms 26 and 27 respectively. A mounting bracket B is provided for mounting the web guiding device 12' on a supporting frame or stand (not shown). The bracket B comprises a main block portion 111 having a right angle base projection 112 and an integral upwardly inclined bracket arm 102 previously described. The base projection 112 has a hole 113 extending downwardly therethrough for the reception of a stud or mounting bolt (not shown) by which the bracket B is adjustably secured to a support frame or stand at a predetermined angle with respect to the direction of travel of the web 10. A bore 117 extends perpendicularly through the main block portion 111 for mounting the outer end of the axle 24 of the bottom roll 15. The axle 24 is fixed in the bore through the main block portion 111 by a set screw 114 which extends downwardly through a threaded bore 114' in the main block portion 111 into locking engagement with the axle 24. The support bracket 25 for the pivoted upper roll 14 is bolted to the bracket B by cap screws 115 (only one shown) extending through the ears 110 on opposite sides of the upstanding arms 26 and 27. By providing elongated vertical slots in the bracket ears 110 through which the cap screws 115 pass, the bracket 25 has limited vertical adjustment. In order to keep the bracket 25 properly oriented it is preferable to provide the brackets 25 and B with a mating key and keyway which permits sliding of the bracket 25 relative to the mounting bracket B in a linear path.

Figure 8:
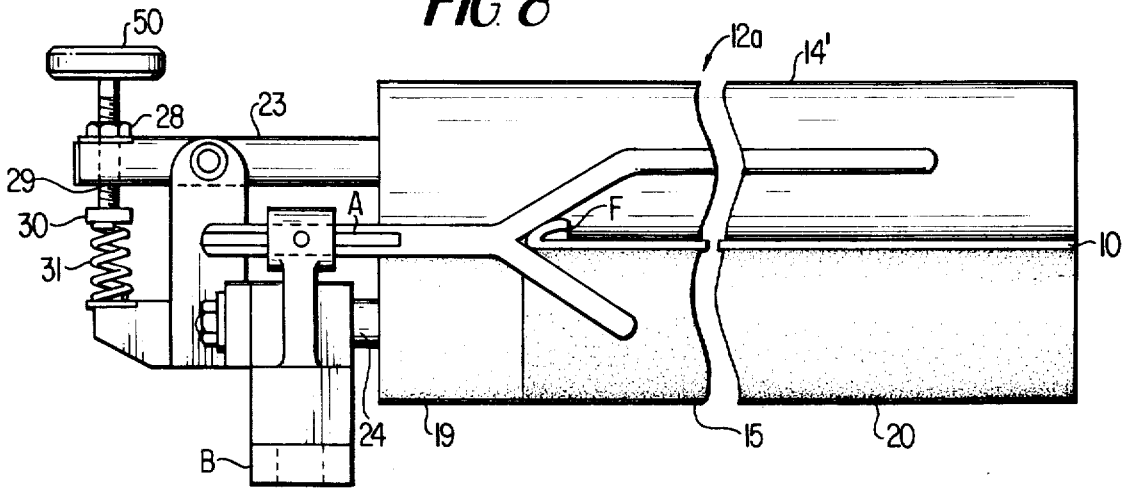
FIG. 8 is an elevational view with portions broken away of another embodiment of the guiding device of this invention.

FIG. 8 shows a guiding device 12a which is similar to the guiding device 12' except that the upper roll 14' has a one piece roll surface while the lower roll 15 has a composite roll surface like the bottom roll 15 shown in FIGS. 1–4 and in FIGS. 5–7. The surface of the upper roll 14' is preferably of a hard high coefficient of friction material such as Teflon, stainless steel, fiber etc. while the composite surface of the lower roll includes a low coefficient of friction outboard surface portion 19 and a high coefficient of friction inboard surface portion 20. The pressure of the upper roll 14' (under the influence of compression spring 31) forcing the web 10 against the high coefficient of friction inboard surface portion 20 of the lower roll 15 is sufficient to prevent slipping of the web relative to the inboard surface portion. However, when the rolls 14' and 15 spread apart as the web is pulled laterally outward to a position where the fold F is between the outboard surface portion 19 and the upper roll 14', the web is no longer forced against the high coefficient of friction inboard surface portion 20 and slippage of the web from between the outboard surface portion 19 of the lower roll and the upper roll can occur. Although not shown, it is entirely within the scope of this invention that the roll 14' with the one piece surface and the roll 15 with the composite surface may be interchanged. That is, the roll 14' may be placed on the bottom axle 24 and the roll 15 may be placed on the top axle 23, and vice versa.

Figure 9:
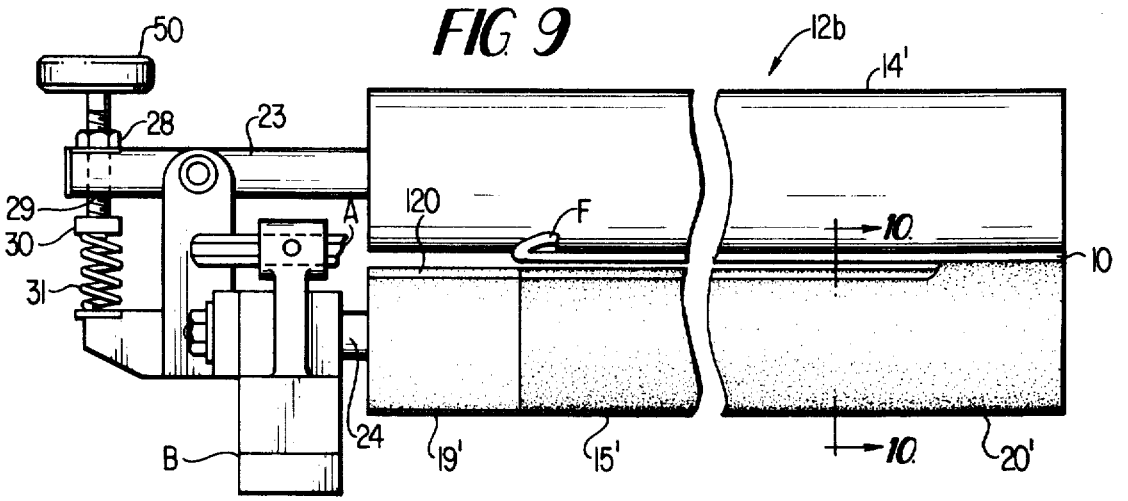
FIG. 9 is an elevational view with portions broken away of still another embodiment of the guiding device of this invention.
Figure 10:
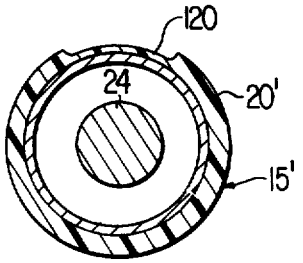
FIG. 10 is a cross sectional view taken on line 10—10 of FIG. 9.

FIGS. 9 and 10 show a guiding device **12*b* which is like the guiding device 12*a* except that the surface of the composite bottom roll 15' is provided with a narrow elongated surface recess 120 which is parallel to the axis of the roll. The recess 120 extends from the outer edge of the outbound surface portion across the outer surface portion 19' and partially across the inboard surface portion 20' of the roll 15'. The purpose of the recess 120 is to insure more positive performance of the guides by causing cyclical bounce to the rolls 14' with each revolution of the rolls 14' and 15'** so as to implement the releasing action of the guide when the web is pulled outward into the area of the low coefficient of friction cover portion. It also gives the rolls a bite (so to speak) when the web edge is inward of the low coefficient of friction cover portion.

Figure 11:
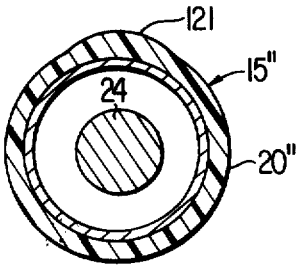
FIG. 11 is a sectional view similar to FIG. 10 of a composite roll having a projecting bump instead of a recessed area.

Instead of providing the lower roll with a recess, a modified lower roll 15'' may include an elongated bulge or bump 121 as shown in FIG. 11. The roll 15'' is like the roll 15' except that the bulge 121 has been provided to replace the recess 120. The cyclical bounce caused by the bulge 121 implements the releasing action of mating guide rolls in the same way as the bounce caused by the recess 120. While FIG. 9 shows the recess 120 to be less than the full length of the roll surface, the recess 120 and the bump 121 can be full length if certain types of material respond better with the recess or bump full length. The recess 120, bump 121, or other means for acheiving a bounce can be provided in the surface of either one of the rolls, and is not limited to use in the lower roll as shown in FIGS. 9–11. The bounce action can be acheived in other ways, for instance by providing a bump on one or both rolls in an appropriate place.

While in the foregoing there has been described and shown a preferred embodiment of the invention, various modifications and equivalents may be resorted to within the spirit of the invention as claimed.

What is claimed is:

1. In a web guiding device for guiding a moving web, a pair of co-acting rolls for engaging an edge portion of the web on its opposite faces, adjustable means for mounting said pair of co-acting rolls in engagement with the edge of a moving web at a predetermined angle to and at a predetermined distance from a selected center line for the moving web, means supporting one of said rolls for rotation about a fixed axis, means pivotally supporting the other of said rolls to swing in a single plane normal to the web and common to both rolls toward and away from said one roll, resilient means for biasing said pivotally supported roll to swing toward said one roll, at least one of said rolls having cylindrical inboard and outboard roll portions, said inboard roll portion being relatively soft and of a high coefficient of friction, said outboard roll portion being relatively hard and of a low coefficient of friction.

2. The device of claim 1 wherein said inboard roll portion is made of an elastomeric rubber-like material, and said outboard roll portion is made of a hard fluorocarbon synthetic resin.

3. The device of claim 1 wherein both of said rolls have said cylindrical inboard and outboard roll portions.

4. The device of claim 1 wherein only one of said rolls has said cylindrical inboard and outboard roll portions and the other of said rolls has a single cylindrical surface of the same material throughout its length.

5. In a web guiding device for guiding a moving web, a pair of co-acting rolls for engaging an edge portion of the web on its opposite faces, means for mounting said pair of co-acting rolls in engagement with the edge of a moving web, means supporting one of said rolls for rotation about a fixed axis, means pivotally supporting the other of said rolls to swing in a single plane common to both rolls toward and away from said one roll, resilient means for biasing said pivotally supported roll to swing toward said one roll, at least one of said rolls having cylindrical inboard and outboard roll portions, said inboard roll portion being relatively soft and of a high coefficient of friction, said outboard roll portion being relatively hard and of a low coefficient of friction, at least one of said rolls including surface means for causing a cyclical bounce of one roll relative to the other during each revolution of said rolls.

6. The device according to claim 5 wherein said surface means for causing a cyclical bounce comprises an elongated recess extending longitudinally along the surface of at least one of said rolls.

7. The device according to claim 5 wherein said surface means for causing a cyclical bounce comprises an elongated bulge extending longitudinally along said surface of at least one of said rolls.

8. In a web guiding device for guiding a moving web, a pair of co-acting rolls for engaging an edge portion of the web on its opposite faces, means for mounting said pair of co-acting rolls in engagement with the edge of a moving web, means supporting one of said rolls for rotation about a fixed axis, means pivotally supporting the other of said rolls to swing in a single plane common to both rolls toward and away from said one roll, resilient means for biasing said pivotally supported roll to swing toward said one roll, at least one of said rolls having cylindrical inboard and outboard roll portions, said inboard roll portion being relatively soft and of a high coefficient of friction, said outboard roll portion being relatively hard and of a low coefficient of friction, together with folding means for engaging an edge portion of said web prior to the entrance of the edge portion between the co-acting rolls for longitudinally folding said edge portion of the web over upon the main body of the web should the web move laterally off center in the direction of said co-acting rolls beyond a predetermined limit.

9. The device according to claim 8 wherein said folding means comprises a yoke having an elongated stem and a pair of divergent branches connected to one end of said stem and means for mounting said yoke in cooperative association with said co-acting rolls so that said divergent branches straddle the same edge of the web which is engaged by said pair of co-acting rolls.

10. The device according to claim 9 wherein said mounting means for said yoke is adjustable for moving the yoke in a plane parallel to a plane through said co-acting rolls toward and away from said edge of said web.

11. The device according to claim 9 wherein said mounting means for said co-acting rolls includes a mounting bracket, and said mounting means for said yoke comprises a bracket arm projecting from said mounting bracket, said bracket arm having a free end portion through which a bore extends for slidably receiving the stem of said yoke, and fastener means provided in said free end portion for securing said stem in said bore in selected position.

12. The device according to claim 11 wherein said mounting bracket includes a base portion for mounting said mounting bracket on a support relative to said web and an upstanding main block portion from which said bracket arm projects, said main block portion having an axle receiving bore which is substantially parallel to the bore through said bracket arm, said means for supporting said one of said rolls for rotation about a fixed axis comprising a fixed axle having one end secured in said axle receiving bore and an opposite end portion positioned coaxially within said one roll and bearing means rotatably supporting said one roll for rotation on said fixed axle, and said means for pivotally supporting said other roll comprising a pair of spaced upstanding bracket arms extending upwardly from said main block portion, a pivot shaft supported by said upstanding bracket arms, a pivoted axle having one end portion pivotally supported on said pivot shaft and an opposite end positioned coaxially within said other roll, and bearing means rotatably supporting said other roll on said pivoted axle.

13. The device according to claim 12 wherein the end portion of said pivoted axle which is pivoted on said pivot shaft includes an extension on the side of said pivot shaft opposite the axle's other end, an adjustment screw extending transversely through said extension of said pivoted axle, a spring seat projecting laterally from said upstanding bracket arms under said adjustment screw, said resilient means comprising a coiled compression spring supported on said spring seat in axial alignment with said adjustment screw, said adjustment screw being adjustable relative to said pivoted axle extension for varying the compression of said spring and thus varying the bias on said pivotally supported roll relative to the roll with the fixed axle.

14. Apparatus for guiding and centering a moving web of substantially constant width relative to a selected fixed center line, said apparatus comprising a pair of web guiding devices which are spaced transversely opposite each on opposite sides of the selected center line, each of said guiding devices comprising a pair of co-acting rolls for engaging an edge portion of the web on its opposite faces, adjustable means for mounting said pair of co-acting rolls at a predetermined angle to and at a predetermined distance from a selected center line for the moving web, means pivotally supporting one of said rolls to swing in a single plane normal to the web and common to both rolls toward and away from the other roll, resilient means for biasing said one roll to swing toward said other roll, at least one of said rolls having cylindrical inboard and outboard roll portions, said inboard roll portion being relatively soft and of a high coefficient of friction, said outboard roll portion being relatively hard and of a low coefficient of friction.

15. The apparatus according to claim 14 wherein said inboard roll portion is made of an elastomeric rubber-like material, and said outboard roll portion is made of a hard fluorocarbon resin material.

16. The apparatus according to claim 15 wherein said hard fluorocarbon resin material is "Teflon".

17. Apparatus for guiding and centering a moving web of substantially constant width relative to a selected fixed center line, said apparatus comprising a pair of web guiding devices which are spaced transversely opposite each on opposite sides of the selected center line, each of said guiding devices comprising a pair of co-acting rolls for engaging an edge portion of the web on its opposite faces, adjustable means for mounting said pair of co-acting rolls at a predetermined angle to and at a predetermined distance from a selected center line for the moving web, means pivotally supporting one of said rolls to swing in a single plane common to both rolls toward and away from the other roll, resilient means for biasing said one roll to swing toward said other roll, at least one of said rolls having cylindrical inboard and outboard roll portions, said inboard roll portion being relatively soft and of a high coefficient of friction, said outboard roll portion being relatively hard and of a low coefficient of friction, each of said guiding devices includes folding means for engaging an edge portion of said web prior to the entrance of the edge portion between the co-acting rolls for longitudinally folding said edge portion of the web over upon the main body of the web should the web move laterally off center in the direction of said co-acting rolls beyond a predetermined limit.

18. The device according to claim 17 wherein said folding means comprises a yoke having an elongated stem and a pair of divergent branches connected to one end of said stem and means for mounting said yoke in cooperative association with said co-acting rolls so that said divergent branches straddle the same edge of the web which is engaged by said pair of co-acting rolls.

19. The device according to claim 18 wherein said mounting means for said yoke is adjustable for moving the yoke in a plane parallel to a plane through said co-acting rolls toward and away from said edge of said web.

20. In a web guiding device for guiding a moving web a pair of co-acting rolls for engaging an edge portion of the web on its opposite faces, angularly adjustable means for mounting said pair of co-acting rolls outboard of and adjacent one edge of said web so that said rolls project inwardly and are inclined at a predetermined angle toward a selected center line for the moving web in the direction of travel thereof, said rolls each having an inboard roll portion and an outboard roll portion, said roll portions being joined along a common line of juncture, said inboard roll portion being made of a relatively soft, high coefficient of friction material, and said outboard roll portion being made of a relatively hard, low coefficient of friction material, means for supporting one of said rolls to swing relative to the other roll in a plane normal to the web and common to both rolls from a position in which both rolls are parallel to and adjacent each other to a position where the one roll is angularly disposed relative to the other roll with its inboard roll portion spaced a greater distance from the other roll than its outboard roll portion, and means for yieldingly biasing said one roll to swing toward said other roll.

21. The device according to claim 20 wherein said inboard roll portion is an elastomeric rubber material and said outboard roll portion is Teflon.

22. The device according to claim 20 wherein said inboard roll portion is a polyurethane resin material and said outboard roll portion is steel.

23. The device according to claim 20 wherein said biasing means is adjustable to vary the bias on said one roll.

24. The device according to claim 20 wherein each of said rolls has an inner cylindrical member encompassed by said inboard and outboard roll portions.

25. In a web guiding device for guiding a moving web, a pair of co-acting rolls for engaging an edge portion of the web on its opposite faces, adjustable means for mounting said pair of co-acting rolls in engagement with the edge of a moving web at a predetermined angle to and at a predetermined distance from a selected center line for the moving web, means supporting one of said rolls for rotation about a fixed axis, means pivotally supporting the other of said rolls to swing in a single plane common to both rolls toward and away from said one roll, resilient means for biasing said pivotally supported roll to swing toward said one roll, at least one of said rolls having cylindrical inboard and outboard roll portions, said inboard roll portion being relatively soft and of a high coefficient of friction, said outboard roll portion being relatively hard and of a low coefficient of friction, said rolls, including both the inboard and outboard portions, being of substantially uniform cross section from end to end.

* * * * *